US007336236B2

(12) United States Patent
Lee

(10) Patent No.: US 7,336,236 B2
(45) Date of Patent: Feb. 26, 2008

(54) TRIANGULAR DIPOLE ANTENNA

(75) Inventor: Chang-Jung Lee, Taoyuan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 0 days.

(21) Appl. No.: 11/209,807

(22) Filed: Aug. 24, 2005

(65) Prior Publication Data

US 2007/0052610 A1 Mar. 8, 2007

(51) Int. Cl.
*H01Q 9/28* (2006.01)

(52) U.S. Cl. ..... 343/795; 343/700 MS

(58) Field of Classification Search ..... 343/795, 343/700 MS, 702, 846
See application file for complete search history.

(56) References Cited

U.S. PATENT DOCUMENTS 3,020,550 A * 2/1962 Beever ..... 343/795
5,229,782 A * 7/1993 Hemmie et al. ..... 343/795
5,293,175 A * 3/1994 Hemmie et al. ..... 343/795
5,438,697 A * 8/1995 Fowler et al. ..... 455/347
5,986,609 A * 11/1999 Spall ..... 343/702
6,037,911 A * 3/2000 Brankovic et al. ..... 343/795
6,342,866 B1 * 1/2002 Ho et al. ..... 343/795
6,664,926 B1 * 12/2003 Zinanti et al. ..... 343/700 MS

* cited by examiner

*Primary Examiner*—Hoanganh Le
(74) *Attorney, Agent, or Firm*—Birch, Stewart, Kolasch & Birch, LLP

(57) ABSTRACT

A triangle dipole antenna includes a first substrate, a first radiating part, and a second radiating part. The first substrate has a first surface and a second surface, which is opposite to the first surface. In this case, the first surface has a first feeding point and the second surface has a first grounding. The first radiating part is triangular and disposed on the first surface of the first substrate. The first radiating part has a first interior angle electrically connected to the first feeding point. The second radiating part is triangular and disposed on the second surface of the first substrate. The second radiating part has a second interior angle electrically connected to the first grounding.

17 Claims, 6 Drawing Sheets

圖式

圖式

圖式

圖式

E-Plane
Frequency： 2450 MHz
Peak Gain： 3.26dBi (@99°)
Average Gain： -1.00dBi

圖式

H-Plane
Frequency： 2450 MHz
Peak Gain： 2.19dBi (@116°)
Average Gain： 1.31dBi

圖式

TRIANGULAR DIPOLE ANTENNA

BACKGROUND OF THE INVENTION

1. Field of Invention

The invention relates to a dipole antenna and, in particular, to a triangular dipole antenna which can be applied with the miniaturization product.

2. Related Art

The prosperous development of the wireless transmission industry has carried out various products and techniques for multi-band transmission, so that many new products have the wireless transmission function so as to meet the consumer's demands.

The antenna, which is used for radiating or receiving the electromagnetic wave, is an important component in the wireless transmission system. The wireless transmission system would not work normally such as radiating or receiving data if it lacks of the antenna. Therefore, the antenna is indispensable in the wireless transmission system.

Choosing the suitable antenna not only can be contributive to collocate the appearance of product and to increase transmission characteristics, but also can decrease the production cost. Since the designing method and manufacturing materials are different when designing the antenna for varied application products, and the working frequency band are different in different countries, it is very critical for designing the antenna.

The size of a conventional dipole antenna is unable to reduce effectively in order to achieve the horizontal and vertical polarization effects that the customer requested. Thus, the conventional dipole antenna will occupy a certain area when it is integrated onto the printed circuit board, which results in the increases of the volume and the cost of products. In addition, the conventional dipole antenna works normally between the bandwidths of 2.4 GHz and 2.5 GHz, which is not enough for the present wireless communication requirement.

Additionally, referring to FIG. 1, a regular triangular antenna 1 is to dispose the two regular triangular radiating parts 12, 13 on a surface of a substrate 11 and to feed the signal into the antenna 1 through the feeding point 14 and the grounding 15 to cause the frequency resonance. Accordingly, the antenna can work normally. However, the regular triangular antenna 1 has broader working bandwidth, so that it is hard to regulate the needed band range. Therefore, the regular triangular antenna 1 maybe failed the EMI regulation because it's broader working bandwidth function. In brief, the regular triangular antenna 1 will receive the signal of undesired band range. This will restrict the utilizable of the products.

As mentioned above, the conventional dipole antenna has some problems of the antenna size, which can not be easily reduced, and the insufficient working bandwidth. In addition, the conventional regular triangular antenna has the problem of the broader working band range resulting in improper filtering effect. Therefore, it is an important subject of the invention to provide a dipole antenna, which has smaller size and sufficient working bandwidth, and equips with the proper filtering effect. Accordingly, the size of the applying products can be reduced.

SUMMARY OF THE INVENTION

In view of the foregoing, the invention is to provide a triangular dipole antenna, which can reduce the dimension of the antenna and equip with the proper filtering effect.

To achieve the above, a triangular dipole antenna of the invention includes a first substrate, a first radiating part, and a second radiating part.

In the invention, the first substrate has a first surface and a second surface, which is opposite to the first surface. The first surface has a first feeding point and the second surface has a first grounding. The first radiating part, which is disposed on the first surface of the first substrate, is triangular and has a first interior angle. The first interior angle is electrically connected with the first feeding point. The second radiating part, which is disposed on the second surface of the first substrate, is triangular and has a second interior angle. The second interior angle is electrically connected with the first grounding.

As mentioned above, the triangular dipole antenna of the invention disposes two radiating parts, which are triangular, on the two surface of the first substrate respectively. Thus, when regulating the sizes of the first and second interior angles, the needed bandwidths can be achieved. In addition, the invention can not only reduce the dimension of the triangular dipole antenna to apply with more miniaturization products, but also can regulate the working band range of the triangular dipole antenna to provide proper filtering effect.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

The triangular dipole antenna of the invention will be apparent from the following detailed description, which proceeds with reference to the accompanying drawings, wherein the same references relate to the same elements.

Figure 1:
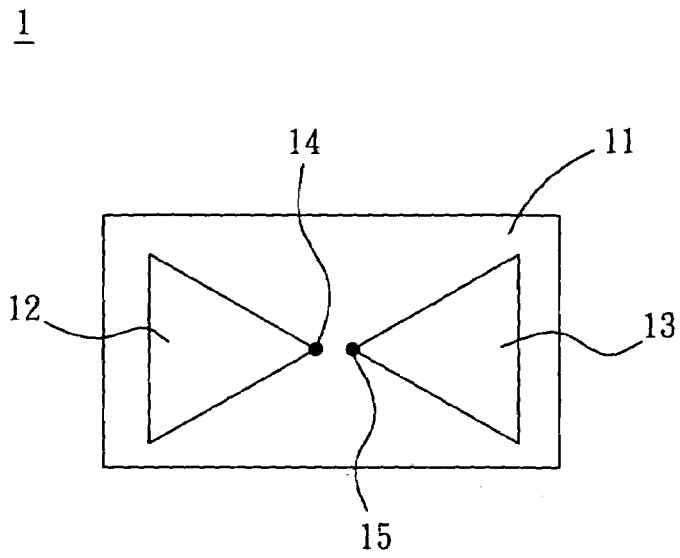
FIG. 1 Prior art
FIG. 1 is a schematic diagram showing a conventional regular triangle antenna.
Figure 2:
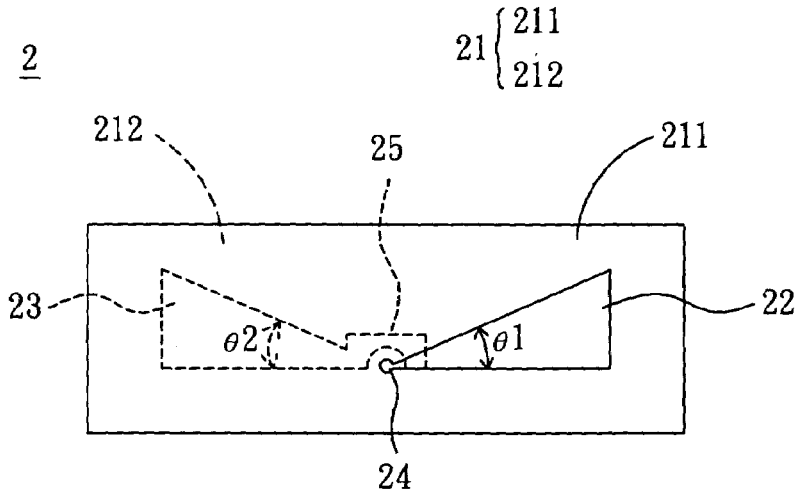
FIG. 2 is a lateral view of a triangular dipole antenna according to an embodiment of the invention.

Referring to FIG. 2, a triangular dipole antenna 2 according to a preferred embodiment of the invention includes a first substrate 21, a first radiating part 22, and a second radiating part 23.

The first substrate 21 has a first surface 211 and a second surface 212, and the first surface 211 is disposed opposite to the second surface 212. In addition, the first surface 211 of the first substrate 21 has a first feeding point 24 and the second surface 212 of the first substrate 21 has a first grounding 25. In the embodiment, the first substrate 21 may be a printed circuit board (PCB), which is made of Bismaleimide-triazine (BT) resin or Fiberglass reinforced epoxy resin (FR4). Furthermore, the first substrate 21 may be a flexible film substrate, which is made of polyimide.

The first radiating part 22 is triangular and disposes on the first surface 211 of the first substrate 21. In addition, the first radiating part 22 has a first interior angle θ1, which is electrically connected with the first feeding point 24. In the embodiment, the first radiating part 22 is right triangular and the first interior angle θ1 is between 15 degrees to 45 degrees. In addition, for feeding the signal into the triangular dipole antenna 2, the triangular dipole antenna 2 further includes a transmission line electrically connected to the feeding point 24 (not shown). The transmission line may be a micro-strip line or a coaxial transmission line. More particular, if the transmission line is the coaxial transmission line, the first feeding point 24 is electrically connected with a core conductor of the coaxial line.

Figure 3:
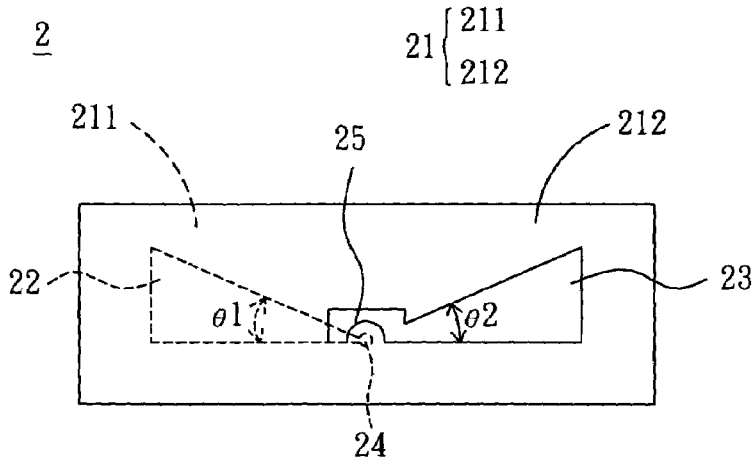
FIG. 3 is another lateral view of the triangular dipole antenna according to the embodiment of the invention.

Referring to FIG. 3, the second radiating part 23 is triangular and disposes on the second surface 212 of the first substrate 21. In addition, the second radiating part 23 has a second interior angle θ2, which is electrically connected with the first grounding 25. In the embodiment, the second radiating part 23 is right triangular and the second interior angle θ2 is between 15 degrees to 45 degrees. In addition, the first grounding 25 can be connected with a ground of a printed circuit board when the triangular dipole antenna 2 is integrated to the printed circuit board. Alternatively, if the transmission line is the coaxial transmission line, the first grounding 25 is electrically connected with a external conductor of the coaxial.

Figure 4:
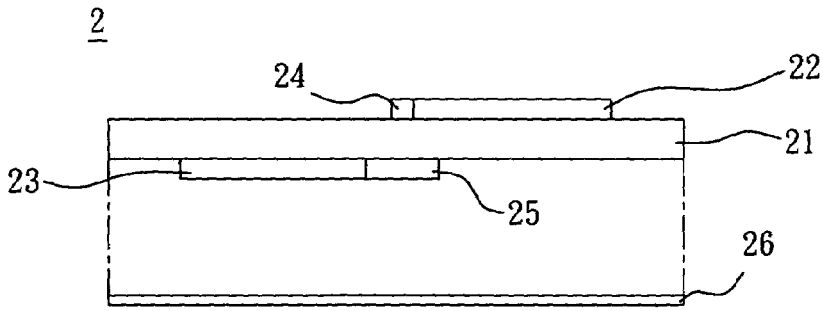
FIG. 4 is a cross-sectional diagram showing the triangular dipole antenna according to the embodiment of the invention.

Referring to FIG. 4, the triangular dipole antenna 2 according to the embodiment of the invention further disposes a first separation layer 26 to cover the first radiating part 22 or the second radiating part 23. In the embodiment, the first separation layer 26 is made of Polypropylene.

Figure 5:
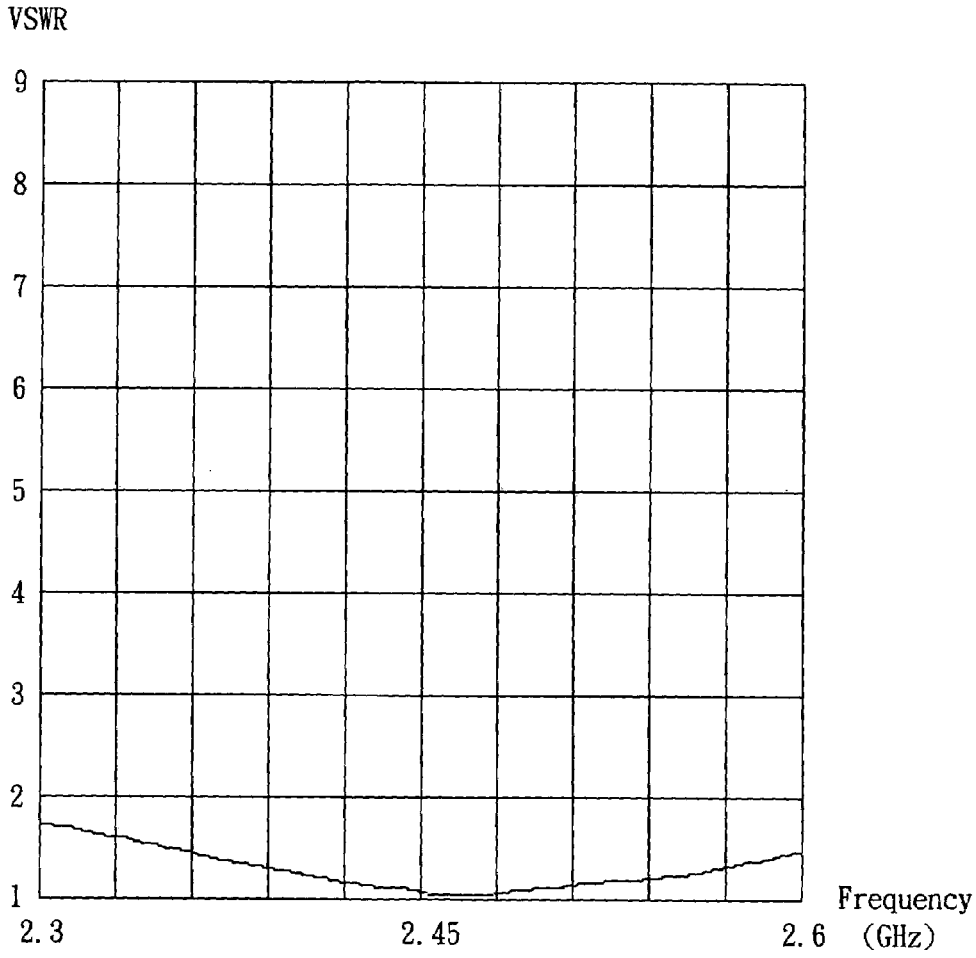
FIG. 5 is a measure diagram showing a working band range of the triangular dipole antenna according to the embodiment of the invention.

Additionally, referring to FIG. 5, the vertical axis represents the voltage standing wave ratio (VSWR), and the horizontal axis represents the frequency. In general, the acceptable definition of the VSWR is smaller than 2. In the present embodiment, the triangular dipole antenna 2 works within the band range of 2.3 GHz to 2.6 GHz. Comparing to the conventional dipole antenna, the triangular dipole antenna 2 of the invention has broader bandwidths and the available band range is restricted to provide the proper filtering effect.

Figure 6:
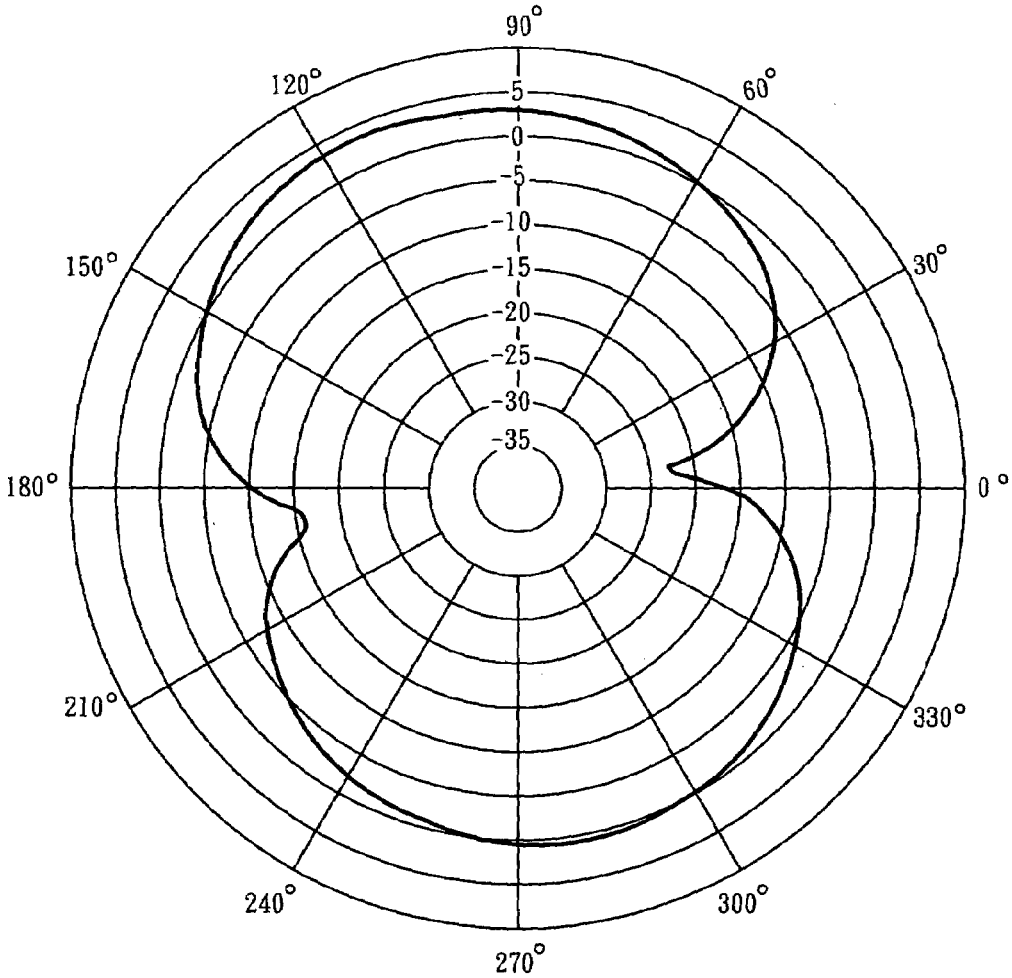
FIG. 6 is a measure diagram showing an E-plan of a radiation pattern of the triangular dipole antenna works at 2.45 GHz according to the embodiment of the invention.
Figure 7:
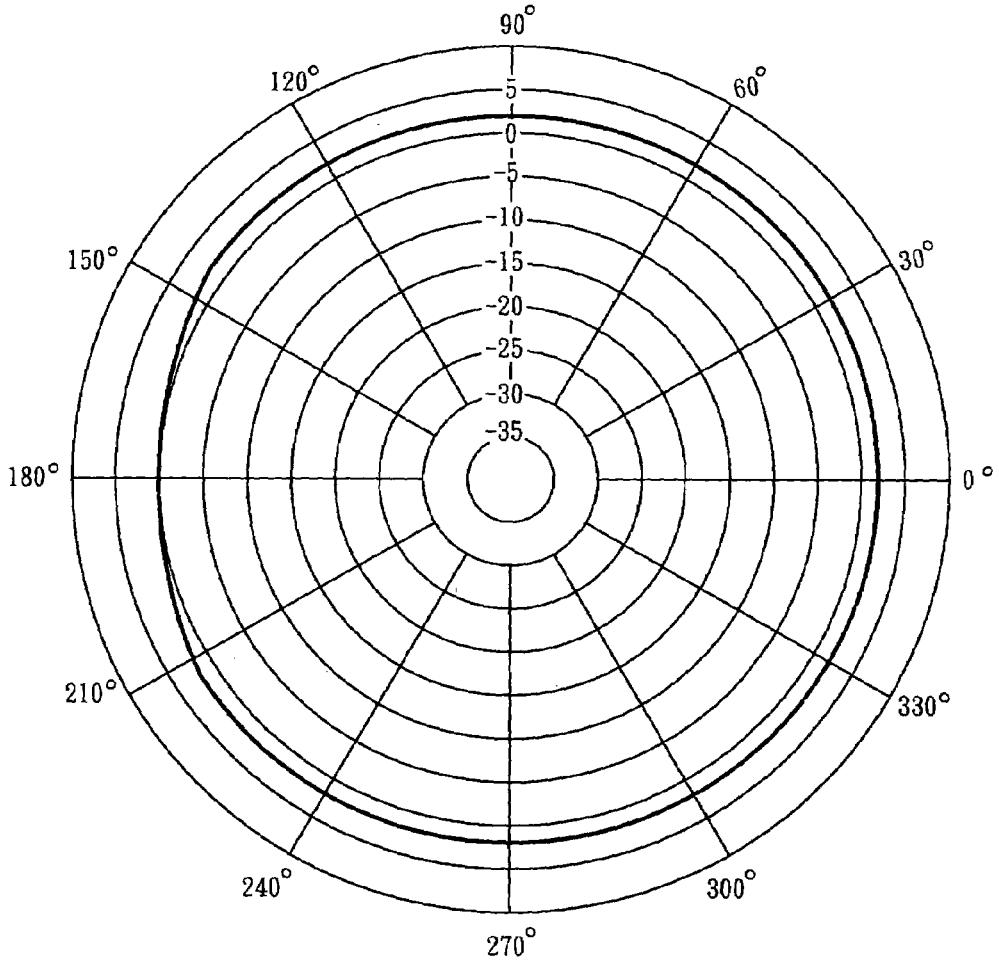
FIG. 7 is a measure diagram showing an H-plan of a radiation pattern of the triangular dipole antenna works at 2.45 GHz according to the embodiment of the invention.

FIG. 6 and FIG. 7 is measure diagrams showing an E-plan and an H-plane of a radiation pattern of the triangular dipole antenna 2 operates at the 2.45 GHz according to the embodiment of the invention.

Figure 8:
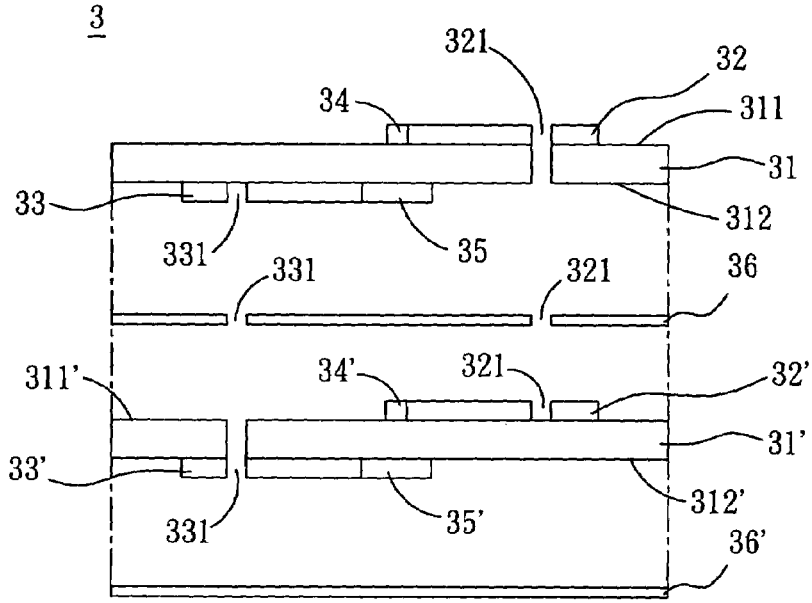
FIG. 8 is a cross-sectional diagram showing an antenna array style of a triangular dipole antenna according to an embodiment of the invention.
Figure 9:
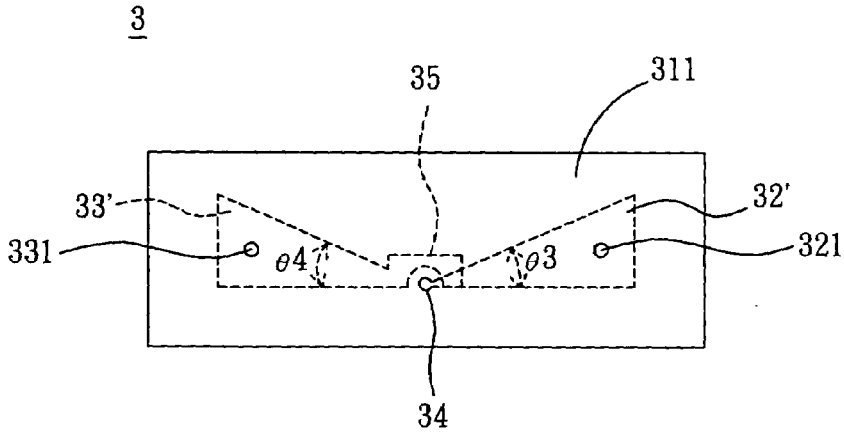
FIG. 9 is a schematic diagram showing the antenna array style of the triangular dipole antenna according to the embodiment of the invention.

Referring to FIG. 8 and FIG. 9, a triangular dipole antenna 3 according to another embodiment of the invention includes a first substrate 31, a first radiating part 32, a second radiating part 33, a second substrate 31', a third radiating part 32', and a fourth radiating part 33'.

The first substrate 31 has a first surface 311 and a second surface 312 and the second substrate 31' has a third surface 311' and a fourth surface 312'. The first substrate 31 is disposed opposite to the second substrate 31' to form an antenna array with the structure of the multilayer printed circuit board. The first radiating part 32 is triangular and disposes on the first surface 311 of the first substrate 31. In addition, the first radiating part 32 has a first interior angle θ1, which is electrically connected with the first feeding point 34. The second radiating part 33 is triangular and disposes on the second surface 312 of the first substrate 31. In addition, the second radiating part 33 has a second interior angle θ2, which is electrically connected with the first grounding 35. The third radiating part 32' is triangular and disposes on the first surface 311' of the second substrate 31'. In addition, the third radiating part 32' has a third interior angle θ3, which is electrically connected with the second feeding point 34'. The fourth radiating part 33' is triangular and disposes on the second surface 312 of the second substrate 31'. In addition, the fourth radiating part 33' has a fourth interior angle θ4, which is electrically connected with the second grounding 35'.

In this embodiment, the structures of the first substrate 31, the first radiating part 32, and the second radiating part 33 are the same as those of the first substrate 21, the first radiating part 22, and the second radiating part 23, so the detailed descriptions are omitted for concise purpose. In addition, the structures of the second substrate 31', the third radiating part 32', and the fourth radiating part 33' are similar to the first substrate 31, the first radiating part 32, and the second radiating part 33 in the embodiment, so the detailed descriptions are also omitted.

In the embodiment, except for forming the antenna array style having the structure of four-layer printed circuit board with two substrates, more substrate can be utilized to form the antenna array style with more printed circuit layers.

The triangular dipole antenna 3 according to the second embodiment of the invention further disposes a first separation layer 36 to cover the first radiating part 32 or the second radiating part 33 and disposes a second separation layer 36' to cover the third radiating part 32' or the fourth radiating part 33. Each of the material of the first separation layer 36 and the second separation layer 36' is Polypropylene.

The triangular dipole antenna 3 further disposes a first via 321 and a second via 331, which pass through the first substrate 31 and the second substrate 31'. In the embodiment, the first radiating part 32 is electrically connected to the third radiating part 32' by the first via 321 and the second radiating part 33 is electrically connected to the fourth radiating part 33' by the second via 331. Of course, the triangular dipole antenna 3 of the invention is not limit to this case only having two via, and the invention may dispose more vias on the triangular dipole antenna 3.

In summary, the triangular dipole antenna of the invention disposes two radiating parts, which are triangular, on the two surface of the first substrate, respectively. Thus, when regulating the sizes of the first and second interior angles, the needed bandwidths can be achieved. In addition, the invention can not only reduce the dimension of the triangular dipole antenna to apply with more miniaturization products, but also can regulate the working band range of the triangular dipole antenna to provide proper filtering effect. Furthermore, the triangular dipole antenna of the invention can be the antenna array type with multilayer printed circuit board to be applied in varied products.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A triangular dipole antenna, comprising:

a first substrate having a first surface and a second surface opposite to the first surface, wherein the first surface has a first feeding point and the second surface has a first grounding;

a first radiating part, which is triangular and disposed on the first surface of the first substrate, wherein the first radiating part has a first interior angle electrically connected to the first feeding point;

a second radiating part, which is triangular and disposed on the second surface of the first substrate, wherein the second radiating part has a second interior angle electrically connected to the first grounding;

a second substrate disposed opposite to the first substrate and having a third surface and a fourth surface opposite to the third surface, wherein the third surface has a second feeding point and the fourth surface has a second grounding;

a third radiating part, which is triangular and disposed on the third surface of the second substrate, wherein the third radiating part has a third interior angle electrically connected to the second feeding point; and a first via passing through the first substrate and the second substrate, wherein the first radiating part is electrically connected with the third radiating part by the first via.

2. The antenna according to claim 1, wherein the first interior angle is between 15 degrees to 45 degrees.

3. The antenna according to claim 1, wherein the first radiating part is a right triangle.

4. The antenna according to claim 1, wherein the second interior angle is between 15 degrees to 45 degrees.

5. The antenna according to claim 1, wherein the second radiating part is a triangle.

6. The antenna according to claim 1, which operates at a frequency between 2.30 Hz to 2.60 Hz.

7. The antenna according to claim 1, further comprising a transmitting line electrically connected to the first feeding point of the first surface to feed a signal into the triangular dipole antenna.

8. The antenna according to claim 1, further comprising a first separation layer covering the first radiating part or the second radiating part.

9. The antenna according to claim 8, wherein the material of the first separation layer is polypropylene.

10. The antenna according to claim 1, wherein the third interior angle is between 15 degrees to 45 degrees.

11. The antenna according to claim 1, wherein the third radiating part is a right triangle.

12. The antenna according to claim 1, further comprising:

a fourth radiating part, which is triangular and disposed on the fourth surface of the second substrate, wherein the fourth surface has a fourth interior angle electrically connected to the second grounding.

13. The antenna according to claim 12, further comprising:

a second via passing through the first substrate and the second substrate, wherein the second radiating part is electrically connected with the fourth radiating part by the second via.

14. The antenna according to claim 12, further comprising a second separation layer covered the third radiating part or the fourth radiating part.

15. The antenna according to claim 14, wherein the material of the second separation layer is polypropylene.

16. The antenna according to claim 12, wherein the fourth interior angle is between 15 degrees to 45 degrees.

17. The antenna according to claim 12, wherein the fourth radiating part is right triangle.

* * * * *